United States Patent [19]

Huhta

[11] 3,997,922

[45] Dec. 21, 1976

[54] GLOVE

[76] Inventor: Birger Johannes Huhta, Hakalaxgatan 79-81 A, Gamlakarleby 10, Finland

[22] Filed: May 12, 1975

[21] Appl. No.: 576,490

[30] Foreign Application Priority Data

May 15, 1974 Finland ..... 1503/74

[52] U.S. Cl. ..... 2/161 A

[51] Int. Cl.[2] ..... A41D 19/00

[58] Field of Search ..... 2/158, 159, 161 A, 161 R, 2/16–20

[56] References Cited

UNITED STATES PATENTS

| | | | |
|---|---|---|---|
| 689,558 | 12/1901 | Meyers | 2/161 R |
| 1,841,193 | 1/1932 | Lidston | 2/16 |

FOREIGN PATENTS OR APPLICATIONS

| | | | |
|---|---|---|---|
| 1,109,306 | 1/1956 | France | 2/161 R |
| 670,862 | 4/1952 | United Kingdom | 2/161 R |

*Primary Examiner*—G. V. Larkin
*Attorney, Agent, or Firm*—Ladas, Parry, Von Gehr, Goldsmith & Deschamps

[57] ABSTRACT

A glove for cross-country skiing. The glove flexes as the skier clenches his fist to grasp his ski pole. The glove is neither stretched nor is the hand of the skier within the glove subjected to tension. The invention accomplishes this result by cuts extending transversely across the back of the glove but terminating short of the glove sides. Inserts of flexible covering material are seated within the cuts and secured to the glove back at the edges of the cuts. In the longitudinal direction of the glove, the inserts have a length which is greater than the width of the cuts within which the inserts are seated.

3 Claims, 3 Drawing Figures

GLOVE

The present invention relates to a glove for use in cross country skiing and having on its upper side, at the knuckles and possibly at the first finger joints, cuts into which are inserted pieces having a larger dimension in the longitudinal direction of the glove than the respective dimension of said cuts.

In skiing the arms and hands perform considerable work with the aid of ski sticks. In this connection it is of utmost importance that the blood circulation in the arms and hands functions well.

Most skiers use finger gloves which, in order to provide a good hold of the stick, must fit the hand as well as possible. Ordinary gloves, however, then have a tendency to tighten on the hand when it clasps the stick. Since the time in a cross country ski race is in general 1 to 3 hours, said tension causes a considerable deterioration of the blood circulation in the hands resulting in untimely fatigue.

Up to now attempts have been made to solve the above mentioned problem in various ways. Thus some skiers have used somewhat too big gloves whereby, however, vexatious, abrasive lumps are formed in the grip of the glove. Attempts have also been made to make the glove curved in advance by using a longer upper side than the underside when sewing up the glove. In this way a fairly satisfactory glove has been obtained; however, the manufacture of such a glove is expensive and difficult. When sewing together the upper and lower part of the glove the edge of the upper part must be pleated together making sewing up by machine very difficult, especially in connection with finger gloves.

Motorcyclists and downhill skiers use gloves having at the knuckles elastic bands permitting the length of the upper side of the glove to increase correspondingly upon clenching the hand. Such a glove is described in French Pat. No. 1,000,930, Gamet. However, the purpose of these gloves is to protect the knuckles against hits and therefore the elastic band or bands tightens strongly around the knuckles to provide a good protection. Thus the effect of such a glove is just the opposite of what is desired in cross country skiing.

The object of the present invention is to provide a glove fitting the hand well without tension on the hand when clenching it. This object has been achieved with the glove according to the invention, in which said cuts end slightly before the side edges of the upper side of the glove and said pieces inserted in the cuts are fastened only at the edges of the cuts so that, when the hand is clenched, the length of said inserted pieces and thus the length of the upper side of the glove is increased without stretching and without tension on the hand. The inserted pieces are preferably of soft leather or fabric. Since the cuts end slightly before the edge of the upper side of the glove, the glove can be made with identical upper and under halves facilitating in a decisive way machine-making of the glove.

The glove according to the invention fits the hand well be it open or closed and always gives a good hold of the stick which is of utmost importance as the hand of the skier opens and closes anew around the stick with each push of the stick. When the hand is stretched the inserted pieces filling the cuts are pleated, and when the hand is clenched said inserted pieces are straightened out without any tension on the hand or the fingers.

The invention will be described in more detail in the following with reference to the accompanying drawing.

Figure 1:
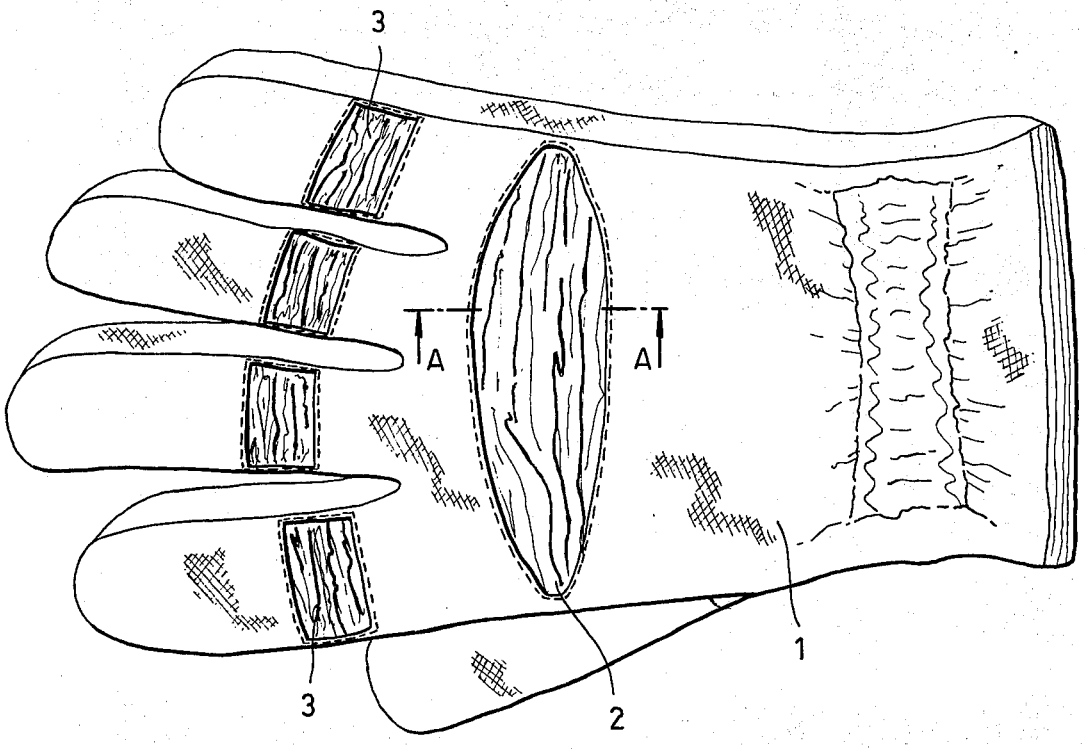
FIG. 1 shows the invention when applied to a finger glove.
Figure 3:
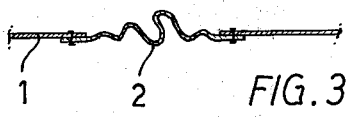
FIG. 3 shows the inserted knuckle piece in section taken along line A—A in FIG. 1.

In the drawing number 1 marks the upper side of a finger glove having the same dimensions as the underside of the glove. At the knuckles and first and second finger joints the glove has cuts sewn up by pieces 2, 3. The pieces have a larger dimension in the longitudinal direction of the glove than the corresponding cuts, which may simply be formed by slits in the upper side of the glove. When the glove is, as shown in the drawing, straightened out the inserted pieces 2, 3 are consequently somewhat pleated. Usually also the thumb is provided with a piece corresponding to the inserted pieces, which piece, however, is not shown in the drawing. If desired, the fingers of the glove can, of course, at the second finger joints be provided with corresponding cuts and with inserted pieces filling them. The cuts do not reach right up to the edge of the fingers and knuckle parts respectively of the upperside 1 which results in a considerable technical advantage in the manufacture, since identical upper and undersides can be used which can be easily joined together by machine.

Figure 2:
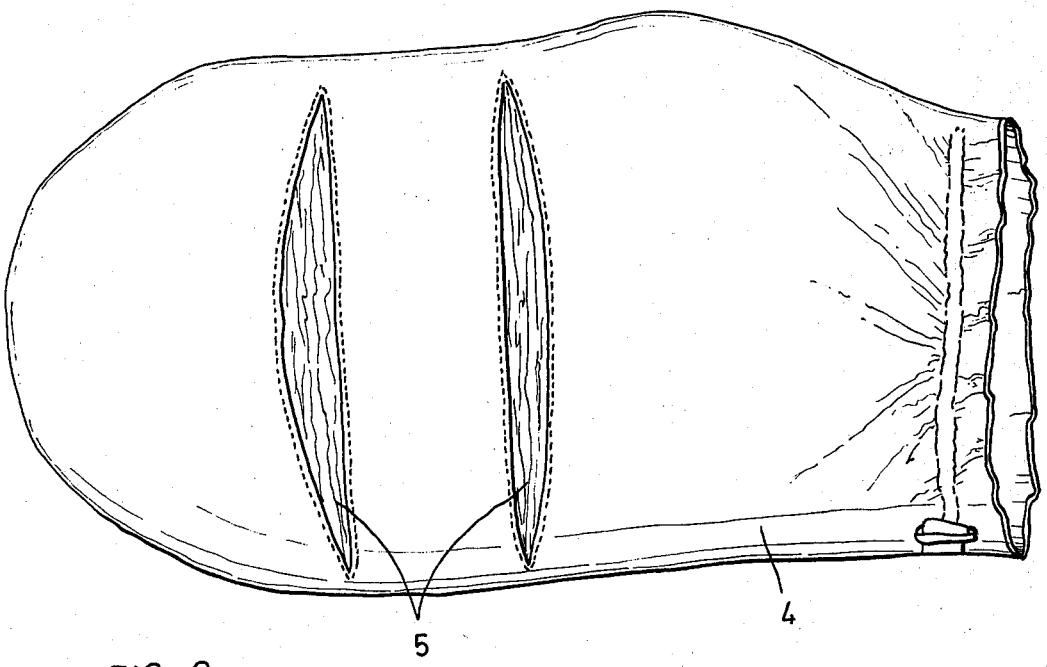
FIG. 2 shows the invention when applied to a mitten.

FIG. 2 shows the idea of the invention applied to a mitten, wherein the upper side 4 of the glove is provided with cuts which do not reach up to the edge of the upper side and which are filled with pieces 5 having a larger dimension in the longitudinal direction of the glove than the respective dimension of said cuts.

What I claim is:

1. For use in cross country skiing a glove having a palm, a back and two sides, wherein said back has transverse cuts at least at the location of the knuckles and finger first joints, said cuts extending transversely across the glove and terminating short of the sides, and wherein inserts of flexible covering material are seated within the cuts and secured to said glove back only at the edges of said cuts, the lengths of said inserts in the longitudinal direction of the glove being greater than the width of the respective accommodating transversely extending cuts whereby, upon a clenching motion of the fist to increase the width of the cuts, the inserts take up the increased width of the cuts.

2. A glove according to claim 1, wherein said inserts are of soft leather.

3. A glove according to claim 1, wherein said inserts are fabric.

* * * * *